US006095072A

United States Patent [19]

Kaufhold

[11] Patent Number: 6,095,072

[45] Date of Patent: Aug. 1, 2000

[54] SEWING INSTALLATION FOR THE PRODUCTION OF A PIPED POCKET OPENING

[75] Inventor: Tobias Kaufhold, Bielefeld, Germany

[73] Assignee: Durkopp Adler Aktiengesellschaft, Germany

[21] Appl. No.: 09/392,410

[22] Filed: Sep. 9, 1999

[30] Foreign Application Priority Data

Oct. 5, 1998 [DE] Germany ..... 198 45 623

[51] Int. Cl.[7] ..... D05B 3/10

[52] U.S. Cl. ..... 112/470.05; 112/68; 112/163

[58] Field of Search ..... 112/470.05, 68, 112/65, 67, 70, 76, 130, 163

[56] References Cited

U.S. PATENT DOCUMENTS 3,747,545 7/1973 Nicolay et al. .
3,820,481 6/1974 Nicolay .
4,075,954 2/1978 Hintzen et al. ..... 112/68
4,416,204 11/1983 Kaze ..... 112/68
5,259,328 11/1993 Noltge et al. ..... 112/68
5,400,731 3/1995 Goldbeck et al. .
5,513,585 5/1996 Diekmann et al. ..... 112/68
5,640,917 6/1997 Nii et al. ..... 112/475.09

*Primary Examiner*—Peter Nerbun
*Attorney, Agent, or Firm*—Robert F. I. Conte; Lee, Mann, Smith, McWilliams, Sweeney & Ohlson

[57] ABSTRACT

A sewing installation for the production of a lined pocket opening on a workpiece comprises a stand on which a working plate is supported. A cutting device for the production of corner cuts in the workpiece is disposed underneath the working plate. This cutting device is held on a support which lodges in the stand pivotally about an axis so that the cutting device can be moved into a position in which it is free from the working plate.

7 Claims, 6 Drawing Sheets

SEWING INSTALLATION FOR THE PRODUCTION OF A PIPED POCKET OPENING

BACKGROUND OF THE INVENTION

1. Field of the Invention

The invention relates to a sewing installation for the production of a piped pocket opening on a cloth workpiece, comprising a stand; a working plate disposed on the stand; a two-needle sewing machine disposed on the working plate; a workpiece advancing device for the transport of the workpiece in a Y-direction on the working plate; a knife for the production of a straight incision running in the Y-direction in the workpiece during the transport thereof in the Y-direction; a cutout running in the Y-direction in the working plate; a cutting device for the production of corner cuts in the workpiece, which cutting device is disposed underneath the cutout of the working plate, which cutting device is disposed in a first position underneath the cutout of the working plate, and which cutting device is provided with two corner cutting knives; and at least one drive coupled with the corner knives for the displacement of the corner cutting knives in a Z-direction through the cutout in the working plate and through the workpiece placed thereon.

2. Background Art

In a sewing installation of the generic type known from U.S. Pat. No. 3,747,545, the cutting device for the production of corner cuts is mounted on a side wall of the stand that supports the working plate. In particular adjusting jobs, but also assembly jobs, are extraordinarily hard to perform, since the cutting device is positioned and fixed underneath the working plate.

In a comparable sewing installation known from U.S. Pat. No. 5,400,731, the cutting device is mounted on support plates which are fixed to the underside of the working plate. As regards the difficulties of adjusting and assembly jobs, what has been said above also applies in this case.

SUMMARY OF THE INVENTION

It is an object of the invention to embody a sewing installation of the generic type such that the mounting and adjusting jobs to be performed on the cutting device are easily feasible.

According to the invention this object is attained by the cutting device being supported on the stand for pivotability from its first position into a second position in which it is at least substantially free from the working plate. Due to its pivotability through the working plate and out of the cover as it were, the cutting device is easily accessible so that the mentioned jobs can be carried out easily and consequently a lot more rapidly and at a lower cost than so far.

Details of the invention will become apparent from the ensuing description of an exemplary embodiment, taken in conjunction with the drawing.

DESCRIPTION OF THE PREFERRED EMBODIMENT

Figure 7:
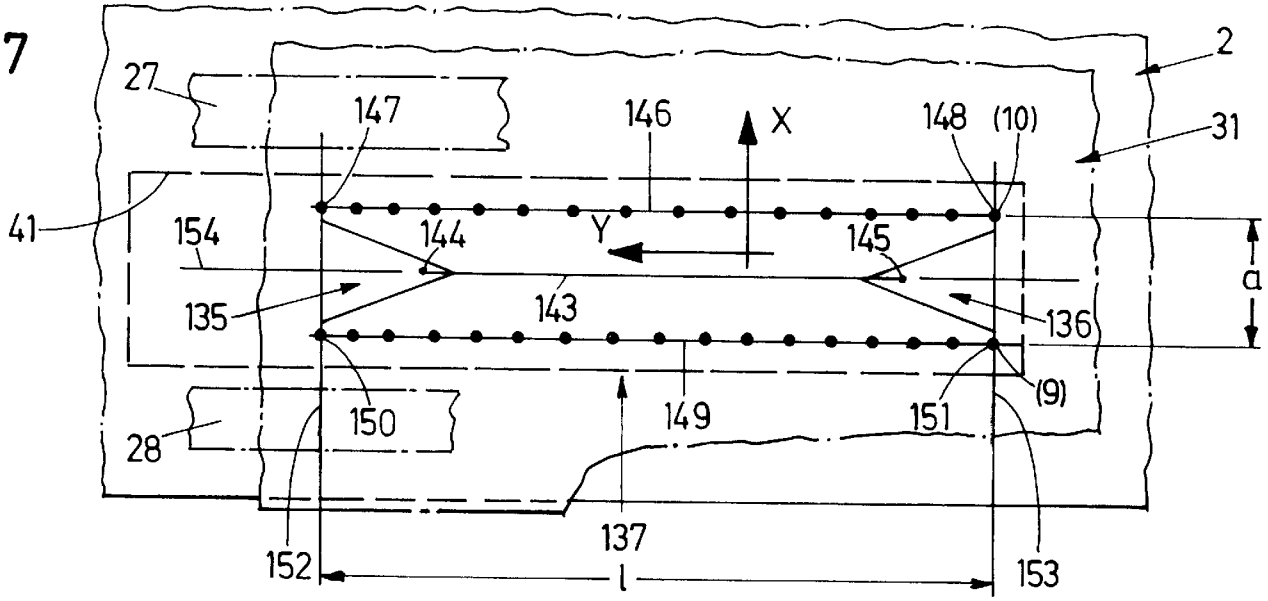
FIG. 7 is a plan view of a cloth workpiece placed on a working plate and having straight corner cuts which are symmetrical to each other.

A sewing installation 1 is provided with a working plate 2 which extends approximately on a horizontal plane that is defined by X- and Y-directions of an extension at right angles to each other. The working plate 2 has a lateral edge 2*a*. A two-needle sewing machine 3 is fixed by its base plate 4 on the working plate 2. The two-needle sewing machine 3 generally has an arm 5 which terminates in a head 6. In the head 6, provision is male for a crank drive (not shown) for the actuation of two needle bars 7, 8, which can be switched on and off individually and in each of which a needle 9, 10 is fixed. The needles 9, 10 are disposed at a distance a of for instance 12 mm from each other in the X-direction as seen in FIG. 7 where the reference numerals of the needles 9, 10 are roughly outlined in parentheses.

A knife 11 is disposed above the working plate 2 on the head 6 between the needles 9, 10 and centrally relative thereto referred to the X-direction and is movable up and down in a Z-direction of an extension at right angles to the X- and Y-directions by means of a drive (not shown) that is disposed in the head 6. The knife can be moved into an upper position of rest and a lower working position. In the position of rest (FIG. 1), the knife 11 is above the working plate 2; for the performance of a cutting motion, it makes an up and down movement in the direction of the Z-axis.

The two-needle sewing machine 3 further comprises a handwheel 12 which is connected with a drive motor 14 via a belt drive 13. The drive motor 14 combines with a motor control (not shown nor described) to form a unit. In combination with the motor control, the drive motor 14 is a commercial sewing machine drive which permits to actuate and stop the two-needle sewing machine 3 in a defined way so that switching the two needle bars 7, 8 on and off and switching the knife 11 on and off is performed by the aid of integrated miscellaneous functions. In the vicinity of the handwheel 12, the two-needle sewing machine 3 is provided with a support arm 15, to the free end of which is fixed a control panel 16 with operating elements 17.

A plate 18 is mounted on the arm 5 of the sewing machine 3 and thereafter in the Y-direction; the plate 18 is joined to a guide 19 constituted by two guide rods which are parallel to each other and on which a carriage 20 lodges for reciprocating displacement in the Y-direction. The carriage 20 is further provided with a bearing 21, in which a double-armed lever 22 lodges pivotally. An arm 23 of the lever 22 is articulated to one end of a piston-cylinder drive 24, which can be actuated pneumatically, and the other end of which lodges pivotally on the carriage 20. A workpiece advancing device 26 is mounted on the free end of the other arm 25 of the lever 22. This arrangement ensures that, by actuation of the drive 24, the lever 22 can be pivoted into a lowered working position 29 and an elevated position of rest 30. According to the illustration of FIG. 7, the workpiece advancing device 26 comprises a first clamping-plate member 27 and a second clamping-plate member 28. The described construction is such that a cloth workpiece 31 placed on the working plate 2 is clamped and fixed by the clamping-plate members 27, 28 and, upon displacement of the carriage 20, is displaced in the Y-direction by the clamping-plate members 27, 28 as a result of friction. Finally attention is drawn to the fact that the free end of the guide 19 that is opposed to the plate 18 is joined to a plate 32 which is in turn joined for stabilization to the plate 18 via a rod 33.

Figure 1:
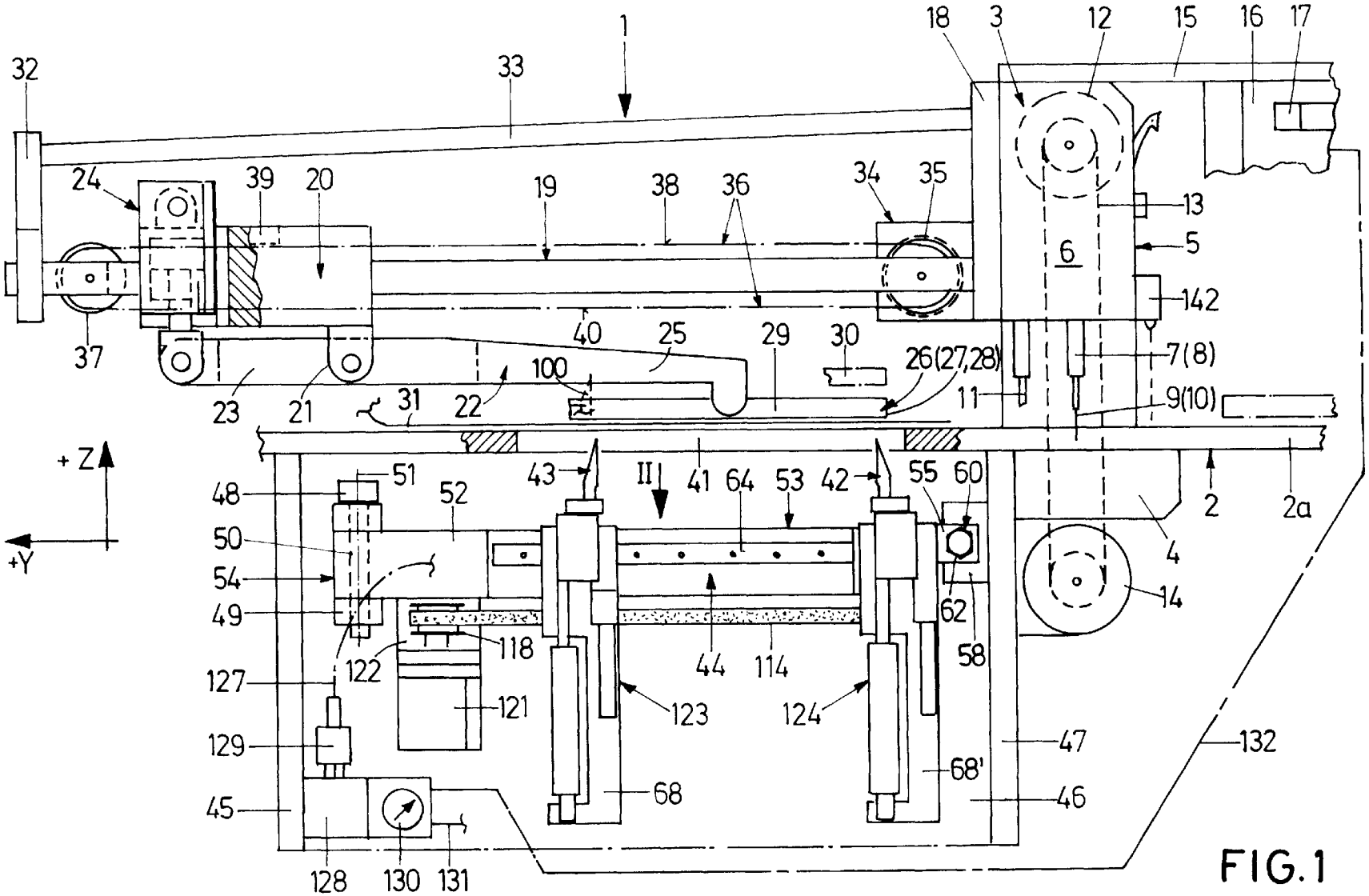
FIG. 1 is a front view of a cutting device according to the invention inserted into a sewing installation.

According to FIG. 1, an electric drive motor 34 in the form of a stepping motor is mounted on the plate 18 after the guide 19 in the X-direction, comprising a timing-belt pulley 35 that is turned towards the carriage 20. The timing-belt pulley 35 is encircled by a continuous timing belt 36 which also encircles timing-belt pulley 37 that is mounted for rotation on the plate 32. The upper strand 38 of the timing belt 36 is joined to the carriage 20 by means of a clamping device 39 disposed on the carriage 20, whereas the lower stand 40 is movable relative to the carriage 20. As a result of the design specified, the carriage 20, and along with it the clamping plate 26, can be displaced by the drive motor 34 to reciprocate on the guide 19 in the positive and negative Y-direction.

As seen in FIGS. 1 and 7, the working plate 2 is provided with a rectangular cutout 41, which extends in the Y-direction in such a way that—as described below—corner cutting knives 42, 43 disposed underneath the working plate 2 are displaceable upwards in the Z-direction through the working plate 2 without being impeded. Attention is drawn to the fact that the working plate 2 is also provided with corresponding recesses for the knives 11 and the needles 9, 10 to pass through downwards.

The design described so far of the sewing installation 1 is known from U.S. Pat. No. 5,400,731, to which reference is made for further details.

The comer cutting knives 42, 43 are components of a cutting device 44 which is described in detail in the following, in particular with reference to FIGS. 1, 2, 3, 4 and 6. The working plate 2 supports itself on a stand formed by walls 45, 46 and 47 and is tightly joined thereto. An upper bearing 48 and a lower bearing 49 is fixed to the rear wall 46. A bearing journal 50, which has an axis 51 running in the Z-direction, is lodged in the bearings 48, 49 and can be removed upwards. An end 52 of a support 53 lodges pivotally on the bearing journal 50. This arrangement helps form a releasable pivoted articulation 54 which is substantially free from play.

Figure 2:
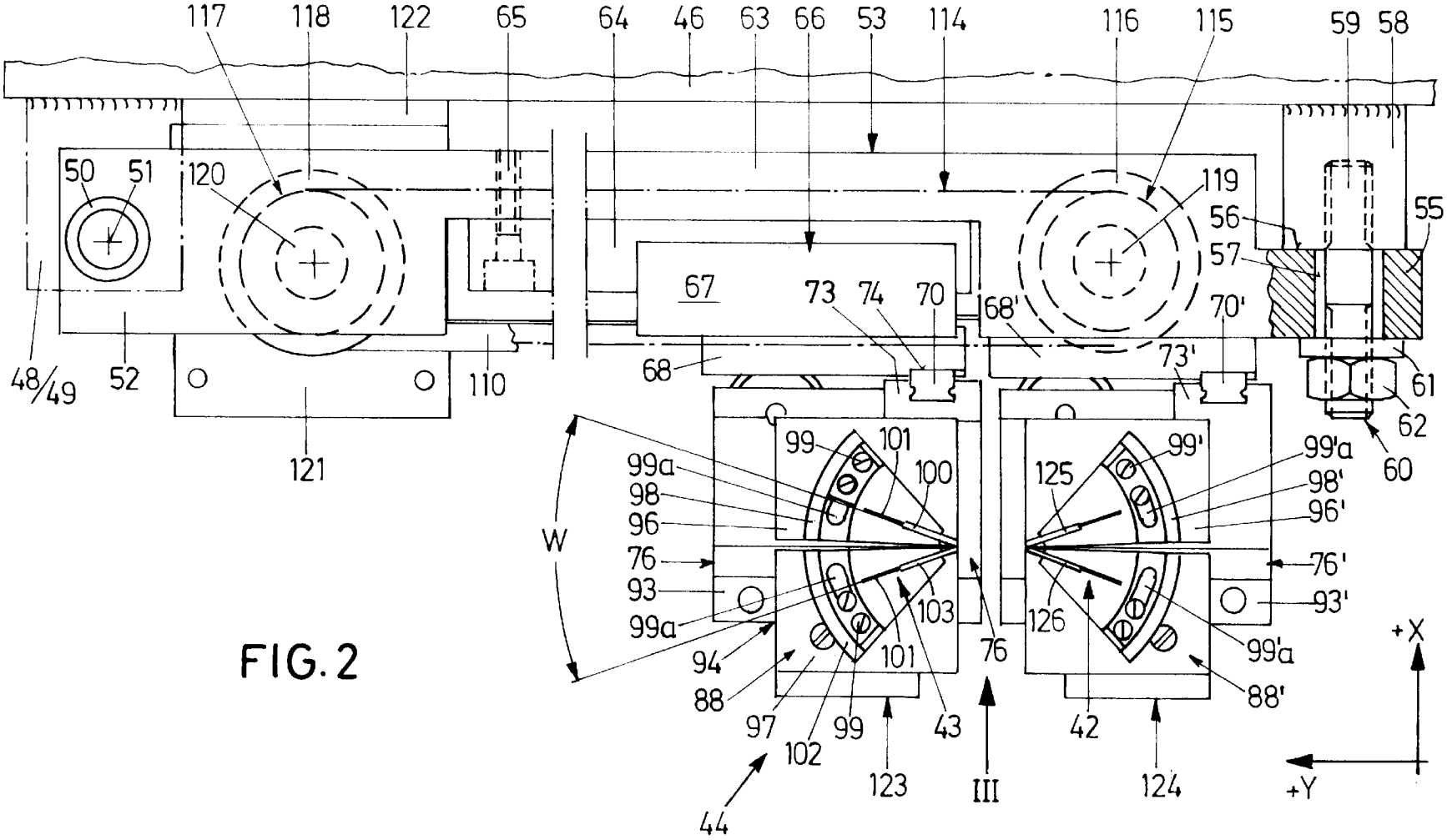
FIG. 2 is a plan view, on an enlarged scale, of part of the cutting device corresponding to the arrow II of FIG. 1.
Figure 5:
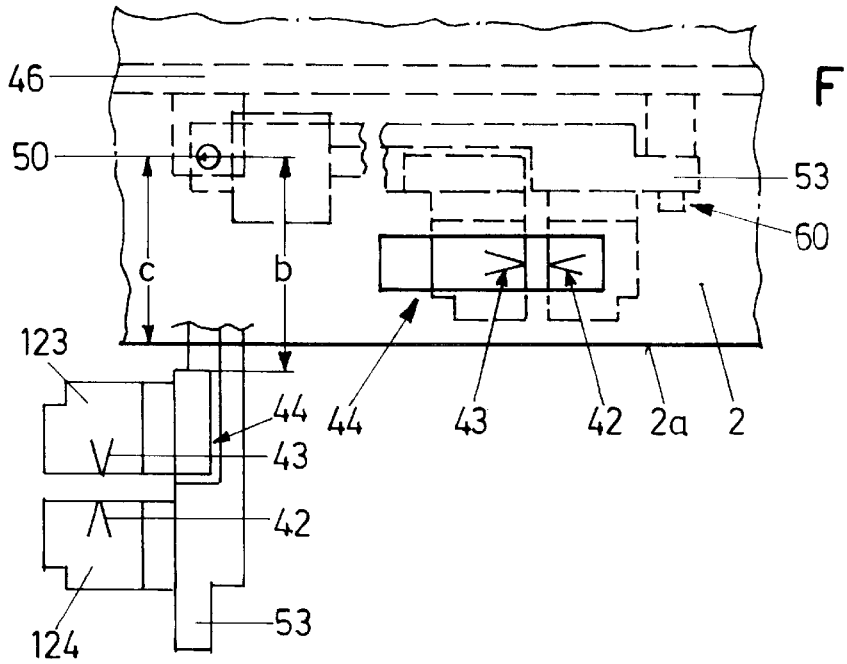
FIG. 5 is a partial view, on a reduced scale, of the cutting device corresponding to the arrow II in FIG. 1.

The free end 55 of the support 53 that is turned away from the articulation 54 is provided with a bearing surface 56 and a through hole 57. A projection 58, which is fitted with a threaded pin 59, is provided on the wall 46 and welded thereon. The out-of-line end 55 of the support 53 is screwed and fixed to the projection 58 by means of a releasable fastening device in the form of the threaded pin 59, a disk 61 and a nut 62. Consequently, the support 53 is releasably fixed to the wall 46 (FIG. 2). After release of the fastening device 60, the support 53 together with the cutting device it supports can be pivoted from the rear wall 46 forwards so that even from above the cutting device 44 is free from the working plate 2 and accessible, as roughly outlined in FIG. 5. In this case it is visible that, when the corner cutting knife 43 is moved as closely as possible to the corner cutting knife 42, the distance b of the axis 51 from the cutting device 44 exceeds the distance c of the axis 51 from the lateral edge 2*a* of the working plate 2 so that the cutting device 44 is entirely free from the working plate 2. After removal of the bearing journal 50, the support 53 inclusive of the cutting device 44 can be taken out of the stand.

The support 53, which is fabricated from a rectangular section, possesses a section 63 of reduced cross-sectional area, to which a guide bead 64 is fixed by screws 65. A guide bearing 66 lodges free from play and for displacement on the guide bead 64. The guide bead 64 and the guide bearing 66 constitute a guide 67 equipped with roll bodies and a sealing as it is commercially available for instance under the trade name "INA vierreihige Miniatur-Kugelurnlaufeinheiten, Baureihe KUME". In the position of work of the support 53 seen in FIGS. 1 and 2, the guide 67 permits a reciprocating motion of the guide bearing 66 in the Y-direction.

Figure 3:
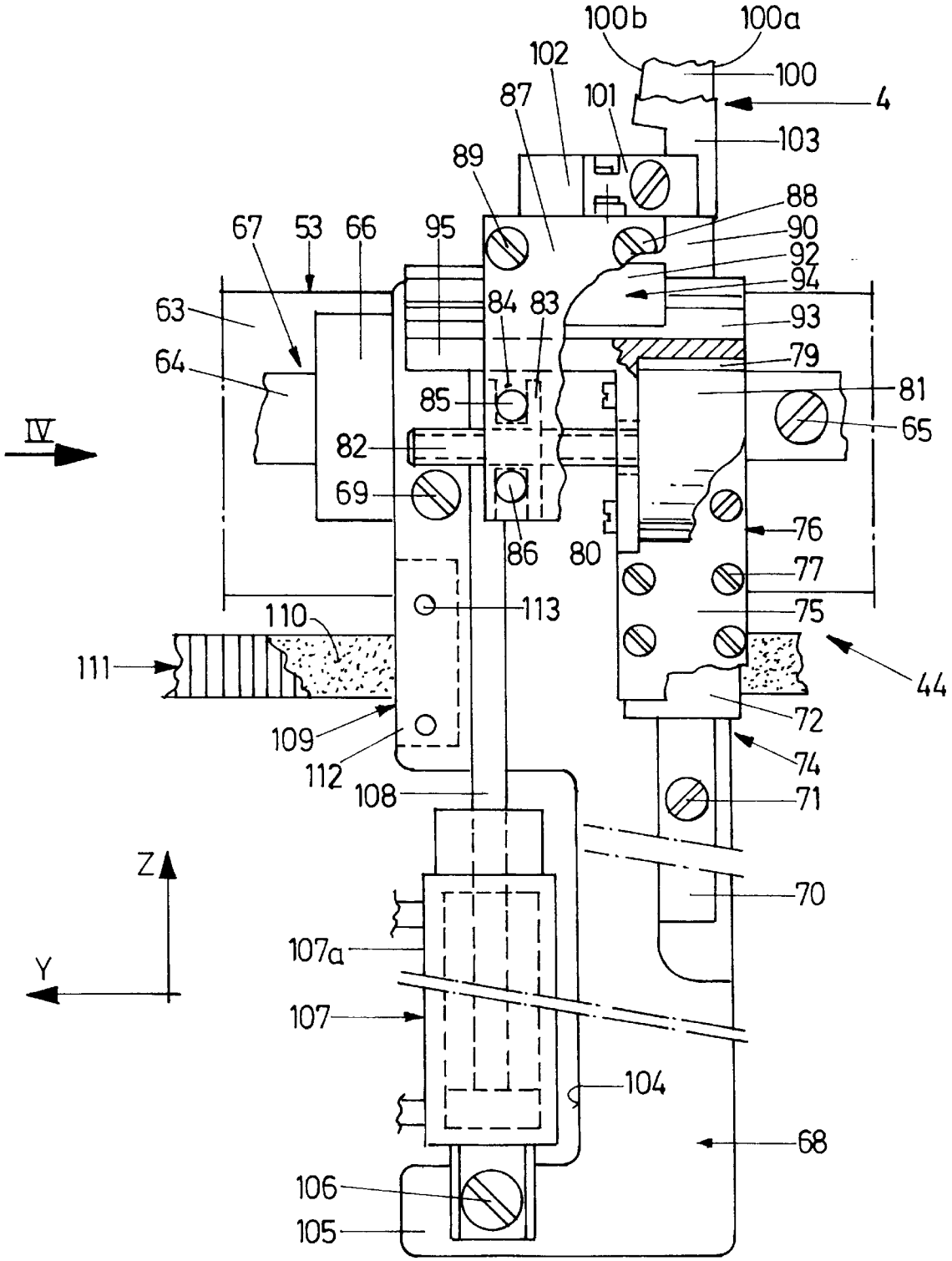
FIG. 3 is a front view of part of the cutting device corresponding to the arrow III of FIG. 2.

A plate 68 is mounted on the guide bearing 66 by four screws 69, only one screw 69 of which is illustrated (FIG. 3). The plate 68 extends by its longer side in the Z-direction. A guide bead 70 is mounted on the plate 68 by screws 71. Two guide bearings 72 and 73, which are side by side, are disposed on the guide bead 70 free from play and for displacement. The guide bead 70 and the guide bearings 72, 73 constitute a guide 74 which corresponds to the design of the guide 67. Consequently, the plate 68 forms a Y-carriage which is allocated to the corner cutting knife 43.

A leg 75 of an angle 76 is fixed to the guide bearings 72, 73 by means of screws 77. The angle 76 possesses another leg 78. In the area of transition of the two legs 75, 78, the angle 76 is provided with a recess 79, which is defined by a wall 80 disposed on the first leg 75. A stepping motor 81 is disposed in the recess 79 and is fixed frontally on the wall 80 by screws which have no reference numerals. The stepping motor 81 is provided with a drive shaft in the form of a threaded spindle 82 which passes with play through a hole (no reference numeral) in the wall 80. The threaded spindle 82 is accommodated free from play and for rotation in a spindle nut 83, which is provided with two recesses 84 of equal design that face each other. Straight pins 85, 86, which are disposed free from play and parallel to each other in the X-direction and which are disposed tightly in a drive member 87, reach into the recesses 84 as a safeguard against rotation and as drivers.

The drive member 87 is screwed on a plate-type table 88 by means of screws 89, 90. By means of screws 91 the underside of the table 88 is joined to a guide bearing 92 which lodges free from play and displaceably on a guide beam 93. The guide bearing 92 and the guide beam 93 form a guide 94, the structure of which corresponds to the guide 67. The guide beam 93 is fixed by means of screws (not shown) on a projection 95 which is formed on the leg 78.

Figure 4:
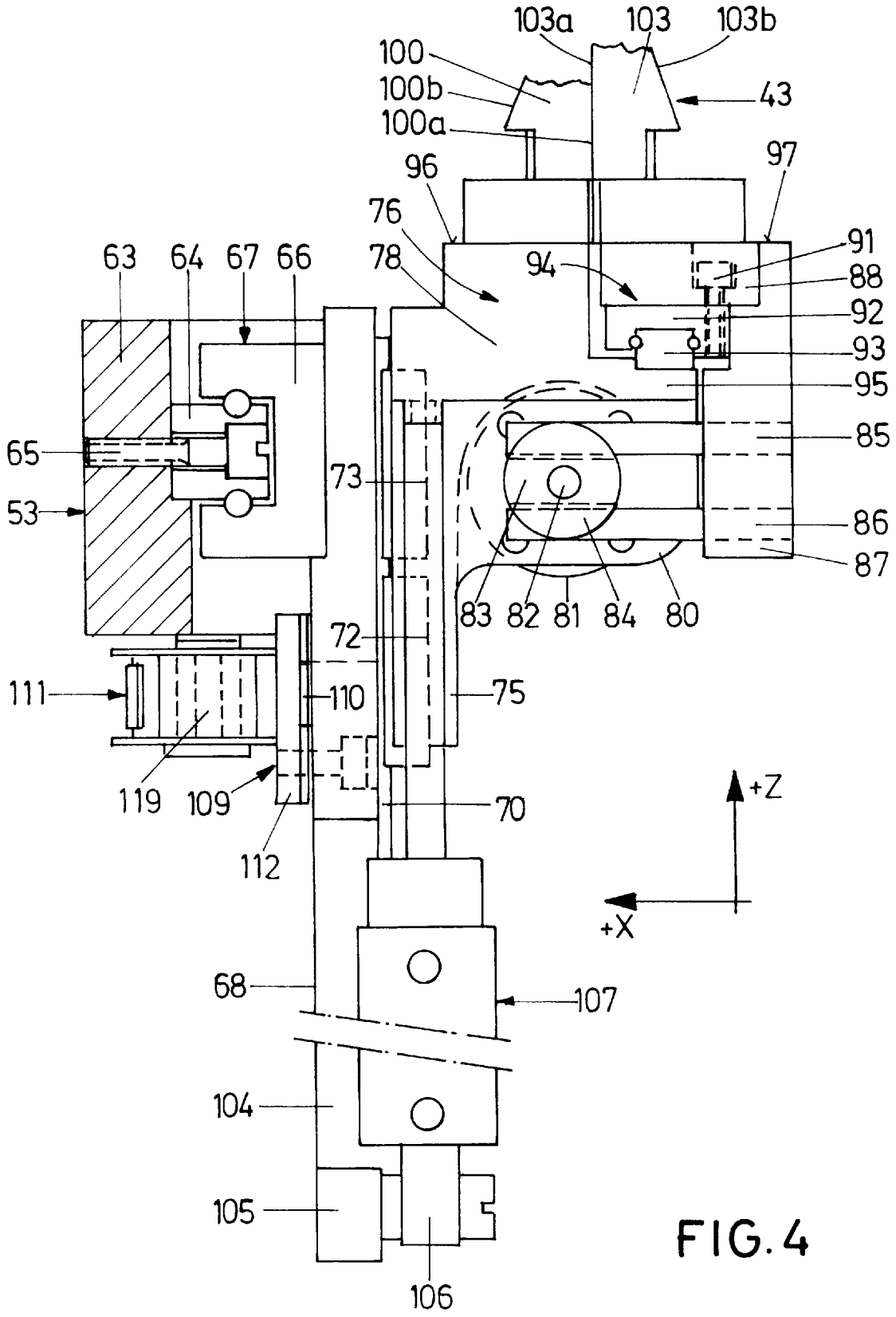
FIG. 4 is a lateral view of the part seen in FIG. 3 corresponding to the arrow IV in FIG. 3.

According to FIGS. 2 and 4, the angle 76 is provided with a supporting surface 96 which runs through the plane formed by the X- and Y-directions. The table 88 has a supporting surface 97 which also extends in the mentioned plane. The construction so far specified ensures that the guides 67, 74, 94 are disposed at right angles to each other in such a way that the angle 76 together with the table 88 is displaceable in the Y- and Z-direction and that the table 88 is additionally displaceable relative to the angle 76 in the Y-direction. Consequently, the angle 76 constitutes a Z-carriage mounted on the plate 68 that forms a Y-carriage. The table 88 constitutes a Y-carriage that is displaceable relative to the angle 76.

A knife carrier 98 in the form of a sector of a circle is fixed to the supporting surface 96 of the angle 76 by screws 99 which pass through an oblong hole 99*a* in the knife carrier 98. A knife 100 is tightly mounted in a releasable clamping device 101 in the knife carrier 98. In like manner a knife carrier 102 is fixed to the supporting surface 97 of the table 88 by screws 99 which also pass through an oblong hole 99*a* in the knife carrier 98. A knife 103 is tightly mounted in a releasable clamping device 101 in the knife carrier 102. Between themselves the two knives 100 and 103 enclose an angle W of 36°. The specified structure permits the angle W to be modified by the screws 99 being loosened and the knife carriers 98 and 102 changing place. The configuration of the knives 100 and 103 is known from the prior art, for instance from U.S. Pat. No. 3,820,481. They are triangular and acute upwardly. They have a non-cutting edge 100*a* and 103*a*, respectively, which runs in the Z-direction and a cutting edge 100*b* and 103*b*, respectively, which moves away from the respective edge 100*a* and 103*a*, downwards so that a drawing cut is attained when the knives 100 and 103 push through a cloth workpiece 31. Owing to the specified design, once the screws 99 have been loosened, the knife carriers 98, 102 can be adjusted about the axis which is formed by the edge 100*a* and 103*a* and runs in the Z-direction.

At its lower end, the plate 68 is provided with a recess 104 and a bearing 105. A lower end 106 of a double-action piston-cylinder drive 107 to be actuated pneumatically lodges on the bearing 105, the cylinder 107*a* of the piston-cylinder drive 107 being disposed in the recess 104. The drive 107 comprises a piston rod 108, the upper end of which is joined to the leg 78 of the angle 76 by way of a screwing 108*a* (FIGS. 3 and 4). The piston-cylinder drive 107 is the Z-drive for the Z-carriage formed by the angle 76.

Furthermore, a clamping device 109 is provided on the plate 68, fastening a strand 110 of a continuous timing belt 111. The clamping device 109 comprises a clamping plate 112 which is braced relative to the plate 68 by means of screws 113 (FIGS. 3 and 4). The timing belt 111 is part of a belt drive 114 and encircles a timing-belt pulley 116 on one side 115 and a timing-belt pulley 118 on another side 117. By means of a bolt 119, the timing-belt pulley 116 is freely rotatably mounted as a deflection pulley on the thicker part of the support 53 near the end 55. The timing-belt pulley 118 is fixed to a shaft 120 of a stepping motor 121 which is mounted on the end 52 of the support 53 by means of a motor bearing 122. As a result of this design, actuation of the plate 68 relative to the support 53 takes place in the Y-direction (FIG. 2). Consequently, the stepping motor 121 is the Y-drive for the plate 68 which constitutes a Y-carriage.

The specified design for the accommodation of the knives 100 and 103 of the corner cutting knife 43 with the essential components such as the plate 68 and the guides 74 and 94 constitutes a first cutting unit 123 of the cutting device 44 which is displaceable in the Y-direction, i.e. not stationary, due to its arrangement on the guide 67.

By contrast to this, a second cutting unit 124 of the cutting device 44, the structure of which corresponds to the cutting unit 123, is tightly disposed on the thick part of the support 53 in the proximity of the end 55 thereof. The second cutting unit 124 comprises knives 125 and 126 as components of the corner cutting knife 42 which are disposed in mirror symmetry to the knives 100, 103. Identical parts, in particular in FIGS. 2 and 6, have the same reference numerals such as that of the cutting unit 123, a prime being added to these reference numerals; there is no need of renewed description.

Figure 6:
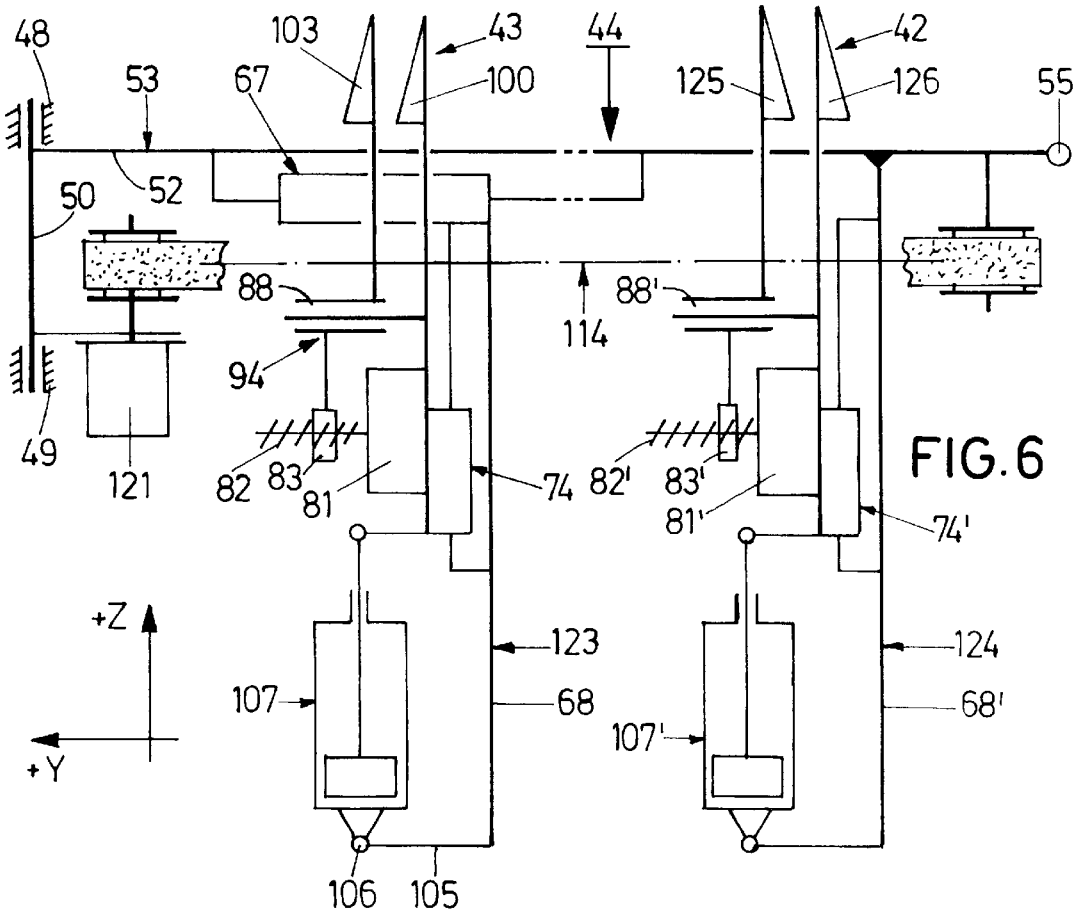
FIG. 6 is a diagrammatic illustration of the cutting device.

The cutting device 44 is equipped with several drives, namely two pneumatic drives 107, 107' of constant and identical stroke, two stepping motors 81, 81' and the stepping motor 121 (FIG. 6). Via a line 127, the drives are connected to a switch box 128 which is fixed to the wall 46. The line 127 comprises electric and pneumatic connection lines to the mentioned drives. The line 127 is connected to the switch box 128 via an interface in the form of a plug connection 129 so that docking the line 127 to, or separating it from, the switch box 128 is easily possible without any special expenditure of time, for example when the support 53 is to be removed from the stand together with the cutting device 44. The switch box 128 is further connected to a maintenance unit 130, to which compressed air is fed from a source via a line 131. The maintenance unit 130 serves for the preparation (cleaning, lubricating and pressure adjustment) of the compressed air originating from the source. Solenoid valves are also disposed in the switch box 128, pneumatically actuating the drives 107, 107'. Furthermore, the switch box 128 is connected via an electric line 132 to the control panel 16 which also accommodates a control unit (FIG. 1).

Figure 8:
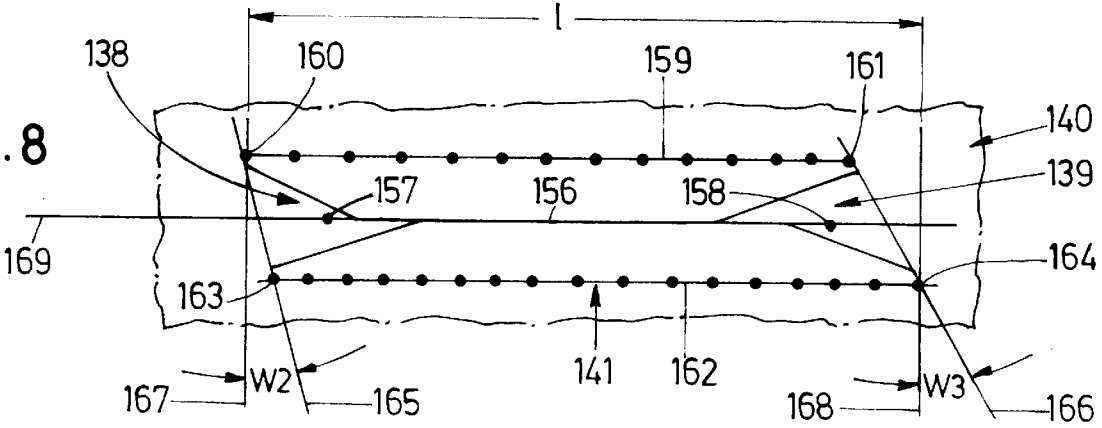
FIG. 8 is a plan view, corresponding to FIG. 7, of another workpiece with diagonal corner cuts.

The mode of operation of the cutting device 44 is as follows: first the control system is supplied with information on the length l (FIG. 7) and the shape of a pocket opening to be produced. Specifying the shape comprises information on whether a pocket opening 137 provided with straight corner cuts 135, 136 is to be produced in the workpiece 31 (FIG. 7) or whether a pocket opening 141 is to be produced which has corner cuts 138, 139 that are diagonal by given angles W2, W3 in a workpiece 140 (FIG. 8).

This information can be fed to the control unit by manual entry at the control panel 16 or automatically. Automatic feed of information takes place for example when a flap (not shown) is to be sewn on additionally in the vicinity of the pocket opening 137 and 141. In this case, detection of the first and second edge of the flap takes place automatically by means of a light barrier unit 142 disposed on the head 6 of the two-needle sewing machine 3, which means the supply to the control unit of information that represents the angles W2, W3 inclusive of the length l, to be produced, of the pocket opening 141.

The example according to FIG. 7 proceeds from the assumption that the workpiece 31, which is clamped on the working plate 2 by the clamping-plate members 27, 28 and by means of the drive 24, is in a position according to FIGS. 1 and 7, covering the cutout 41. It further proceeds from the assumption that the workpiece 31 possesses an incision 143 produced by the knife 11 and having final points 144, 145; a seam 146 produced by the two-needle sewing machine 3 and having final points 147, 148; and a seam 149 running in parallel thereto and having final points 150, 151. The positions of the mentioned final points 147, 148 and 150, 151 of the seams 146, 149 relative to the final points 144, 145 of the incision 143 correspond to the information supplied to the control unit. The final points 147, 150 define a straight line 152 and the final points 148, 151 define a straight line 153 which is parallel thereto. The straight lines 152, 153 run at right angles to a line 154 which extends through the incision 143 and which reflects the working direction of the sewing installation 1.

Based on the described information, the control unit causes the stepping motor 121 to be triggered, whereby the cutting unit 123 is moved into a position relative to the member 124 that defines the desired length l of the pocket opening 137 to be produced. Further, the control unit initiates the triggering of the stepping motors 81, 81' which are contained in the cutting units 123, 124 of the cutting device 44. Via the threaded spindle 82, 82', the respective stepping motor 81, 81' exercises on the nut 83, 83' a motion in the positive or negative Y-direction depending on the direction of rotation of the threaded spindle 82, 82', whereby the respective table 88, 88' and thus the knives 103, 126 are correspondingly displaced. Displacing the respective table 88, 88' takes place in dependence on its initial position in the positive or negative Y-direction. According to FIG. 2, this displacement process is terminated as soon as the knives 100, 103 and 125, 126 take identical positions in the Y-direction. Once these positions are attained, the stepping motors 81, 81' hold still at a stopping torque, fixing the position of the respective table 88, 88' and thus of the knives 103, 126. Attention is explicitly drawn to the fact that the adjustment of the tables 88, 88' takes place—as explained—on both cutting units 123 and 124. Thus the knives 100, 103 and 125, 126 are positioned or aligned relative to each other for the performance of the straight corner cuts 135, 136 according to FIG. 7.

The control unit initiates such a triggering of the drives 107, 107' of both cutting devices 123, 124 in the automatic run of the machine cycle. In this way the angle 76, 76', which is contained in the cutting units 123, 124 and forms a Z-carriage, inclusive of components located thereon is displaced upwards (FIGS. 1 and 3) in the positive Z-direction. By this motion, the knives 100, 103 and 125, 126 move upwards through the cutout 41 without being impeded and pass into the workpiece 31 while performing the corner cuts 135, 136. The uniformly elevated position of all the knives 100, 103, 125 and 126 is roughly outlined in FIG. 1 by way of example for the knife 100 shown by dot-dashes. Since all the knives 100, 103, 125, 126 are always elevated over the full stroke of the drives 107, 107', their depth of penetration into the workpiece 31 is always the same. The clamping-plate members 27, 28 hold the workpiece 31 tight on the working plate 2.

Then the control unit initiates a reversal of the drives 107, 107' of the cutting units 123 and 124 so that the finished workpiece 31 can be removed once the clamping-plate members 27, 28 have been released.

The production of the pocket opening 141 with the corner cuts 138, 139 which are diagonal by the angles W2 and W3 is explained in the following, based on FIG. 8.

As specified in connection with the working of the workpiece 31 according to FIG. 7, the workpiece 140 comprises an incision 156 with final points 157, 158; a seam 159 parallel thereto and with the final points 160, 161; and a seam 162 which is parallel to the incision 156 and the seam 159 and has the final points 163 and 164.

The final points 160, 163 define a straight line 165 and the final points 161, 164 define a straight line 166. The straight line 165 cooperates with the straight line 167 to enclose an angle W2 and the straight line 166 cooperates with the straight line 168 to enclose and angle W3. The straight lines 167, 168 run through the outermost final points 160 and 164 of the seams 159 and 162 and at right angles to the line 169 which is defined by the incision 156 and which defines the working direction of the sewing installation 1 as the line 154.

As described above, the control unit, again based on the given information, initiates an adjustment in the Y-direction of the cutting knife 103 and 125 which belongs to each cutting unit 123, 124 by triggering the respective stepping motor 81, 81', namely corresponding to the given angles W2 and W3. The rest of the process corresponds to that described above for the production of the straight comer cuts 135, 136.

Special attention is drawn to the fact that the angles W enclosed by the knives 100 and 103 of the cutting unit 123 and by the knives 125, 126 of the cutting unit 124 are fundamentally manually adjustable and that the knives 100, 103 and 125, 126, once they are mounted and adjusted, are used without being modified, i.e. without any new adjustment, regardless of the production of the straight comer cuts 135, 136 or the diagonal comer cuts 138, 139.

What is claimed is:

1. A sewing installation for the production of a piped pocket opening (141) on a workpiece (31, 140), comprising a stand (45, 46, 47);

a working plate (2) disposed on the stand (45, 46, 47);

a two-needle sewing machine disposed on the working plate (2);

a workpiece advancing device (26) for the transport of the workpiece (31, 140) in a Y-direction on the working plate (2);

a knife (11) for the production of a straight incision (143, 156) running in the Y-direction in the workpiece (31, 140) during the transport thereof in the Y-direction;

a cutout (41) running in the Y-direction in the working plate (2);

a cutting device (44) for the production of comer cuts (135, 136; 138, 139) in the workpiece (31, 140), which cutting device (44)

is disposed underneath the cutout (41) of the working plate (2), is disposed in a first position underneath the cutout (41) of the working plate, and is provided with two comer cutting knives (42, 43); and at least one drive (107, 107') coupled with the corner knives (42, 43) for the displacement of the corner cutting knives (42, 43) in a Z-direction through the cutout (41) in the working plate (2) and through the workpiece (31, 140) placed thereon, wherein the cutting device (44) is supported on the stand (45, 46, 47) for pivotability from said first position into a second position in which it is at least substantially free from the working plate (2).

2. A sewing installation according to claim 1, wherein the cutting device (44) is held on a support (53), one end (52) of which is joined to the stand (45, 46, 47) by means of a pivoted articulation (54) with an axis (51) that runs in the Z-direction, and another other end (55) of which is joined to the stand (45, 46, 47) by means of a releasable fastening device (60).

3. A sewing installation according to claim 2, wherein the cutting device (44) comprises a first and a second cutting unit (123, 124) each with a corner cutting knife (42, 43), at least the first cutting unit (123) of which is mounted for displacement in the Y-direction relative to the support (53); and wherein the first cutting unit (123) is turned towards the pivoted articulation (54) and the second cutting unit (124) towards the fastening device (60).

4. A sewing unit according to claim 2, wherein a distance b of the cutting device (44) from the axis (51) exceeds a distance c of the axis (51) from an edge **(2*b*) of the working plate (2)**.

5. A sewing installation according to claim 1, wherein the cutting device (44) is detachably mounted on the stand (45, 46, 47).

6. A sewing installation according to claim 2, wherein the support (53) is detachable from the pivoted articulation (54).

7. A sewing installation according to claim 1, wherein a supply line (127) for at least one of electric energy and compressed air is provided, which is releasably connected to drives (81, 81'; 107, 107'; 121) of the cutting device (44) by means of a plug connection (129).

* * * * *